United States Patent [19]

Shick

[11] Patent Number: 4,799,521

[45] Date of Patent: Jan. 24, 1989

[54] HANDLE FOR BAG

[75] Inventor: Lawrence A. Shick, Waquoit, Mass.

[73] Assignee: Lifestyle International, Inc., Randolph, Mass.

[21] Appl. No.: 119,548

[22] Filed: Nov. 12, 1987

[51] Int. Cl.[4] ..... B65D 25/28; A45C 11/32

[52] U.S. Cl. ..... 150/107; 190/115; 190/102; 190/903; 190/120; 383/17

[58] Field of Search ..... 383/17, 6; 190/115, 190/117; 150/107; 229/52 AL; 16/110 R, 116 R

[56] References Cited

U.S. PATENT DOCUMENTS

| | | | |
|---|---|---|---|
| 733,542 | 7/1903 | Converse | 383/16 |
| 2,274,536 | 2/1942 | Doppelt | 190/115 |
| 2,338,279 | 1/1944 | Blake | 383/18 X |
| 3,415,300 | 12/1968 | Worcester | 150/106 |
| 3,682,216 | 8/1972 | Nelson | 383/11 X |
| 3,952,383 | 4/1976 | Moore et al. | 16/116 X |
| 3,977,054 | 8/1976 | Moore et al. | 16/116 X |
| 4,263,951 | 4/1981 | Siegel | 150/106 X |
| 4,506,769 | 3/1985 | Franco et al. | 190/115 X |
| 4,592,091 | 5/1986 | Italici | 383/15 |
| 4,714,143 | 12/1987 | Saliba | 190/115 |

FOREIGN PATENT DOCUMENTS

| | | | |
|---|---|---|---|
| 743182 | 12/1943 | Fed. Rep. of Germany | 190/115 |
| 611264 | 10/1960 | Italy | 190/115 |

*Primary Examiner*—William Price

*Attorney, Agent, or Firm*—Lahive & Cockfield

[57] ABSTRACT

A handle for a bag includes an elongated, flexible sheet member having an attachment region at each end. The attachment regions are adapted for attachment to the bag. The sheet member includes an elongated, rectangular intermediate region between the attachment regions. A welting member is adjacent to the intermediate region. The welting member includes an elongated sheet of relatively highly compressible and resilient material. The intermediate region is folded along its long principal axis so that the long sides of that region are mutually jointed at a seam with the welting member positioned between the two halves of the intermediate region on either side of the principal axis. The handle further includes a plurality of seams joining opposite portions of the two halves along substantially parallel axes extending transverse to the principal axis. The transverse axes are equally spaced in the direction of the principal axis by a distance D. The folded, seamed intermediate region and a welting member form an articulated grip portion for the handle.

9 Claims, 2 Drawing Sheets

HANDLE FOR BAG

BACKGROUND OF THE INVENTION

The present invention is in the field of bags and more particularly relates to hand-carried bags.

In the prior art, there are many forms of handles used with bags particularly adapted for carrying by hand. The simplest, most straightforward handles have the form of an elongated, flexible sheet member which is attached at each of its ends to the bag. Another form commonly used, particularly in "soft" luggage, has the form of an elongated, flexible tube which is filled with a resilient filling material and which is attached at each of it ends to the bag. Yet another form of handle known in the art is exemplified by U.S. Pat. No. 4,592,091 and typically includes a pair of elongated members, each which are attached to the bag, wherein part of one of those members includes a laterally extending flexible region which is adapted to wrap around the other member and be releasably attached in a configuration capturing that other member.

While all of these handle configurations are effective in providing a handle for a bag, they are all characterized by a different "feel" to the user.

It is an object of the present invention to provide an improved handle for use with a bag, particularly a hand-held bag.

Another object is to provide a handle with an improved feel to the user.

SUMMARY OF THE INVENTION

Briefly, in accordance with the present invention, a handle for a bag includes an elongated, flexible sheet member having an attachment region at each end. The attachment regions are adapted for attachment to the bag. The sheet member includes an elongated, rectangular intermediate region between the attachment regions. A welting member is adjacent to the intermediate region. The welting member includes an elongated sheet of relatively highly compressible and resilient material. The intermediate region is folded along its long principal axis so that the long sides of that region are mutually joined at a seam with the welting member positioned between the two halves of the intermediate region on either side of the principal axis.

The handle further includes a plurality of seams joining opposite portions of the two halves along substantially parallel axes extending transverse to the principal axis. The transverse axes are equally spaced in the direction of the principal axis by a distance D. With this configuration, the folded, seamed intermediate region and a welting member form an articulated grip portion for the handle. In various embodiments, the handle may further include a rectangular cover member disposed adjacent to and affixed to the immediate region on the side opposite to the welting member, thereby providing a more sturdy articulated grip portion. Preferably, the intermediate region has a length in the direction of the principal axis of at least approximately 4.0 inches and the dimension D is in the range 0.50 to 0.75 inches. The welting member may be a material such as cotton welting, and the sheet member may be a material such as leather or vinyl or the like.

While this form of handle may be used preferably with soft-sided luggage or bags, for example, having a plurality of nylon sidewall panels joined together to define an interior space, it may be similarly used with other forms of bags as well.

In one form, a bag includes a selectively operable closure assembly, such as a zipper, affixed to the sidepanels and has a lock for fixing the closure assembly in the closed position. The bag may further include a connector assembly having two detachably mating elements, one of the elements being affixed to one of the panels on the interior portion of the bag and the other elements being coupled to a key for the lock. In this form of the invention, one of the elements includes a fibrous pile attached to a substrate and the other of the elements includes a plurality of uniform length, resilient hooks extending from a substrate. Preferably, at least one of those substrates is flexible. With this configuration, a detachable key-holding assembly may be affixed to the interior of the bag.

BRIEF DESCRIPTION OF THE DRAWINGS

The foregoing and other objects of this invention, the various features thereof, as well as the invention itself, may be more fully understood from the following description, when read together with the accompanying drawings in which.

DESCRIPTION OF THE PREFERRED EMBODIMENT

Figure 1:
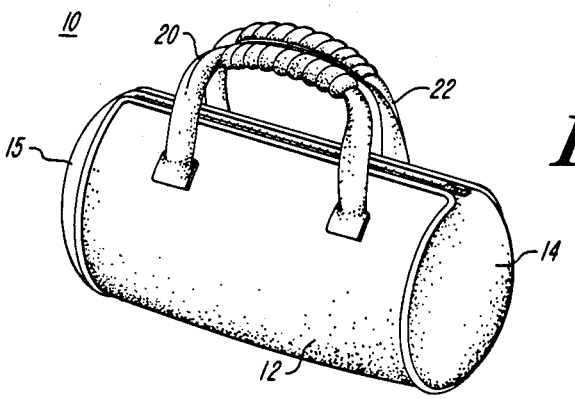
FIG. 1 shows an exemplary bag embodying the present invention.

FIG. 1 shows a bag 10 in accordance with the present invention. Bag 10 includes a body member having four sidepanels 12–15 sewn together at their edges to enclose an interior space. In the exemplary bag 10 of FIG. 1, the bag is generally cylindrical in shape. The sidepanels may be made of conventional material for luggage, such as leather, vinyl, or nylon or other material.

Figure 2:
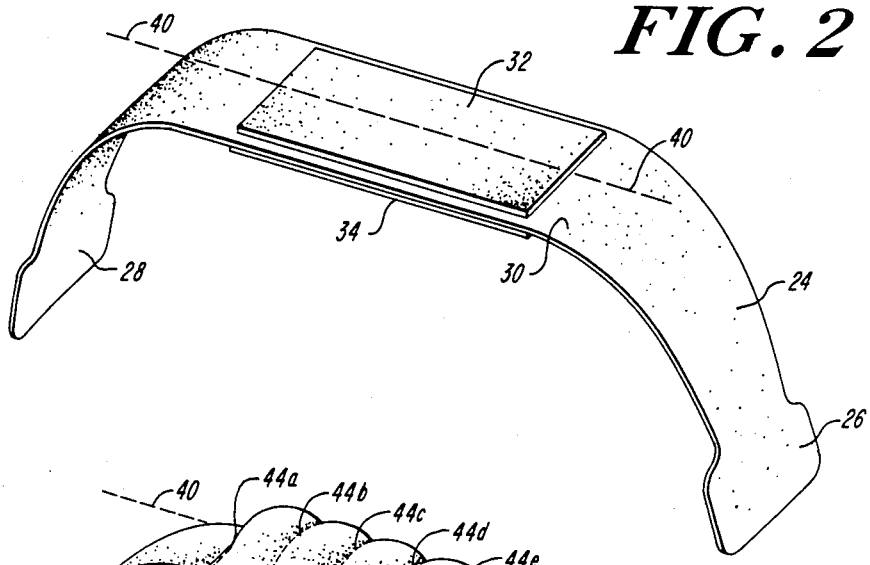
FIG. 2 shows a partially assembled handle for the bag of FIG. 1.

The bag 10 includes two handles 20 and 22 which are substantially identical, except that handle 20 is attached to sidepanel 12 and handle 22 is attached to sidepanel 14. FIG. 2 shows the handle 20 prior to its full assembly and attachment to the bag 10. Handle 20 includes an elongated, flexible sheet member 24 having an attachment region 26 at one end and an attachment region 28 at its other end. These regions 26 and 28 are adapted for attachment to the sidepanel 12 of the bag shown in FIG. 1, for example, by sewing. The sheet member 24 includes an elongated, substantially rectangular intermediate region 30 disposed midway between the attachment regions 26 and 28.

A substantially planar welting member is disposed adjacent to the intermediate region 30. The welting member is an elongated sheet of relatively highly compressible and resilient material, such as cotton, hemp, or nylon welting, 0.75 inch thick. In the illustrated embodiment, a substantially rectangular cover member 34 is affixed to the intermediate region 30 on the side of the intermediate region opposite to the welting member 32.

Figure 3:
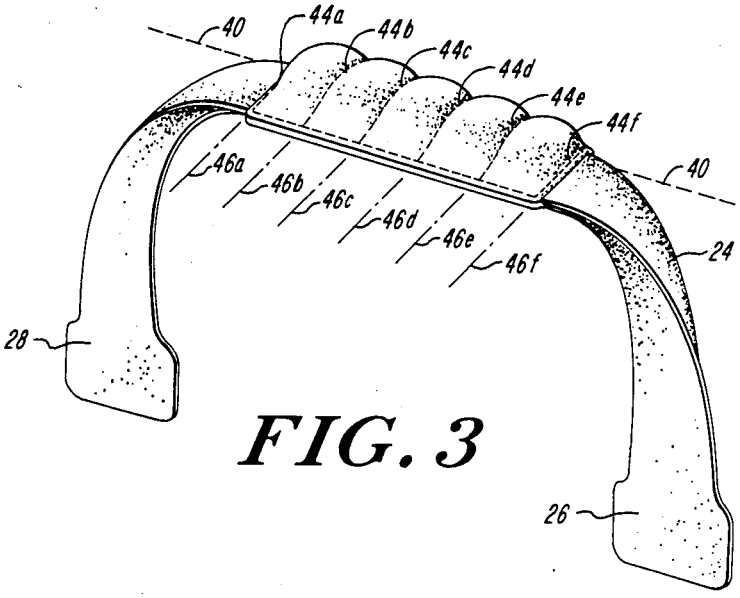
FIG. 3 shows an assembled handle for the bag of FIG. 1.
Figure 4:
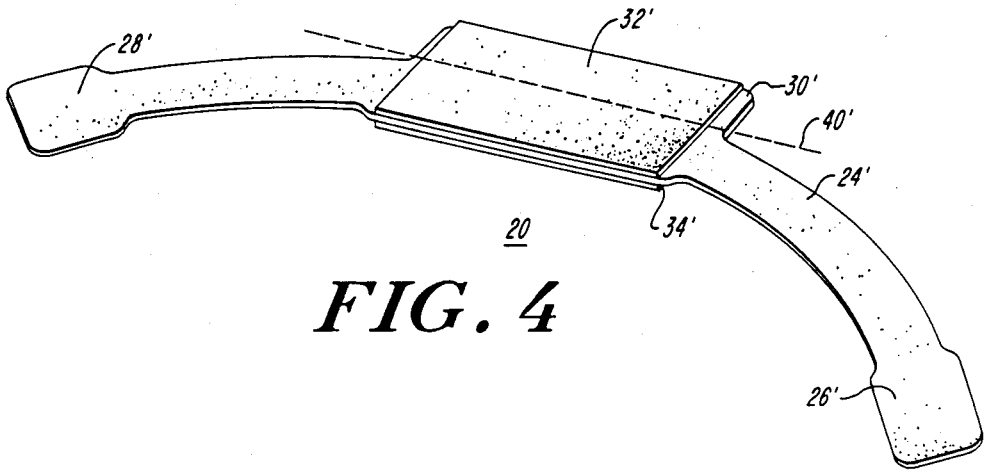
FIGS. 4 and 5 show an alternative handle for use with the bag of FIG. 1.

FIG. 3 shows the handle 20 of FIG. 2 in assembled form. In FIG. 3, the intermediate region 30, welting member 32 and cover member 34 have been folded about the long principal axis 40 of the intermediate region 30, and the long sides of region 30 are mutually joined at a seam 42 so that the welting member is disposed between the two halves of the intermediate region on either side of the principal axis 40. A plurality of seams 44*a*–44*f* are positioned along the intermediate member 30 to join opposing portions of the two halves of the member 30 along a plurality of substantially parallel axes 46*a*–46*f* extending transverse to the principal axis 40. The transverse axes are mutually spaced in the direction of the principal axis 40 by the same distance D, although in other embodiments, the interseam spacing may differ from seam to seam. Preferably, the length of the intermediate region 30 is approximately 4.0 inches and the spacing between the transverse axes D is in the range 0.50 to 0.75 inches.

With this configuration, the folded, seamed intermediate region 30, welting member 32, and cover member 34 form an articulated grip portion for the handle 20. This articulated handle has a high strength and firm, yet flexible, feel to the user of the bag.

Figure 5:
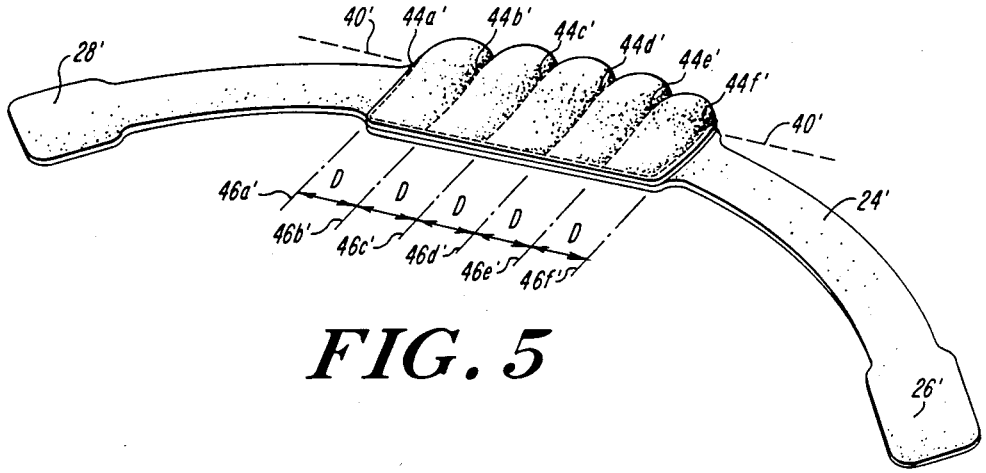
Figure 6:
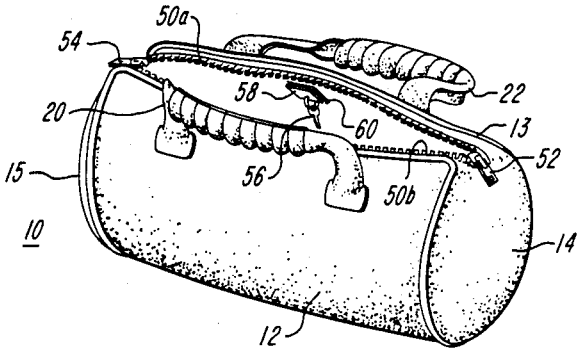
FIG. 6 shows the bag of FIG. 1 in an open position, showing an internally coupled key and its attendant assembly.

FIGS. 5 and 6 show an embodiment 20′ for the handle 20 which is similar to that shown in FIGS. 2 and 3. Elements in handle 20′ which correspond to those in handle 20 are denoted by the same reference designation followed by a prime (′) The intermediate region 30 of handle 20′ is wider than the immediately adjacent portions of sheet member 24′. Otherwise the handle 20′ is the same as the handle 20.

FIG. 6 shows the bag illustrated in FIG. 1 with a closure element 50 in the form of a zipper in an open position. The closure element 50 includes a zipper puller member 52 having an associated lock assembly 54 at the end of the opposing zipper tracks. The puller 52 and lock assembly 54 may be operated in a conventional fashion to lock the puller with the zipper in the closed position. A key 56 for the lock assembly 54 may be used to unlock that assembly. The key 56 is affixed to a substrate 58 which in turn is shown detachably coupled to a complementary substrate 60. The substrate 60 is affixed to the interior of panel 13. Substrates 58 and 60 are coupled to each other with a conventional hook and loop coupling system wherein an array of flexible hooks is affixed to the substrate 58 and a nylon pile is affixed to the substrate 60. In the preferred embodiment, the substrate 58 is flexible while the substrate 60 is rigid, although both may be flexible in different embodiments. With the illustrated configuration, the two substrates may be selectively separated from each other permitting the key 56 to be stored in the interior of the bag when not in use and otherwise removed therefrom and carried with the user.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A handle for a bag, comprising:

A. an elongated flexible sheet member having an attachment region at each of its distal ends adapted for attachment to said bag, and having an elongated, substantially rectangular intermediate region disposed midway between said attachment regions, B. a welting member including an elongated sheet of relatively highly compressible and resilient material disposed adjacent to said intermediate region, wherein said intermediate region is folded along its long principal axis with its long sides being mutually joined at a seam, and wherein said welting member is disposed between the two halves of said intermediate region on either side of said principal axis, and further comprising a plurality of seams joining opposing portions of said two halves along a corresponding plurality of substantially parallel axes extending transverse to said principal axis, said transverse axes being substantially equally spaced in the direction of said principal axis by a distance D, whereby said folded, seamed intermediate region and said welting member form an articulated grip portion.

2. A handle according to claim 1 further comprising a substantially rectangular cover member disposed adjacent to and affixed to said intermediate region on the side of said intermediate region opposite to said welting member.

3. A handle according to claim 1 wherein said intermediate region has a length in the direction of said principal axis of at least approximately 3.0 inches.

4. A handle according to claim 1 wherein said welting member is a material from the group consisting of cotton, hemp and nylon.

5. A handle according to claim 4 wherein said sheet member is leather.

6. A handle according to claim 1 wherein D is in the range 0.50 to 0.75 inches.

7. A bag comprising:

a body member having a plurality of sidewall panels defining an interior space, and at least one handle including:

A. an elongated flexible sheet member having an attachment region at each of its distal ends adapted for attachment to said bag, and having an elongated, substantially rectangular intermediate region disposed midway between said attachment regions, B. a welting member including an elongated sheet of relatively highly compressible and resilient material disposed adjacent to said intermediate region, wherein said intermediate region is folded along its long principal axis with its long sides being mutually joined at a seam, and wherein said welting member is disposed between the two halves of said intermediate region on either side of said principal axis, and further comprising a plurality of seams joining opposing portions of said two halves along a corresponding plurality of substantially parallel axes extending transverse to said principal axis, said transverse axes being substantially equally spaced in the direction of said principal axis by a distance D, whereby said folded, seamed intermediate region and said welting member form an articulated grip portion, and means for affixing said attachment regions to one or more of said sidepanels.

8. A bag according to claim 7 further comprising a selectively operable closure assembly affixed to said sidepanels, said closure assembly including means for selectively fully closing said interior space and a lock and an associated key, and further comprising a connector assembly having two detachably mating elements, one of said elements being affixed to one of said panels within said interior region, and the other of said elements being coupled to said key, wherein one of said elements includes a fibrous pile affixed to a substrate and the other of said elements includes a plurality of uniform length, resilient hooks extending from a substrate, at least one of said substrates being flexible.

9. A handle according to claim 7 wherein D is in the range 0.50 to 0.75 inches.

* * * * *